United States Patent [19]

Barnett

[11] 4,134,780

[45] Jan. 16, 1979

[54] EXPLOSIVE COMPOSITION FLOWABLE OVER WIDE TEMPERATURE RANGE

[75] Inventor: George H. Barnett, North Balwyn, Australia

[73] Assignee: ICI Australia Limited, Victoria, Australia

[21] Appl. No.: 847,052

[22] Filed: Oct. 31, 1977

[30] Foreign Application Priority Data

Nov. 23, 1976 [AU] Australia ..... PC8241
Apr. 29, 1977 [AU] Australia ..... PC9921

[51] Int. Cl.[2] ..... C06B 33/12

[52] U.S. Cl. ..... 149/40; 149/41; 149/42; 149/43; 149/44; 149/46; 149/60; 149/61; 149/76; 149/83; 149/85

[58] Field of Search ..... 149/41, 46, 40, 42, 149/44, 43, 60, 61, 76, 83, 85

[56] References Cited

U.S. PATENT DOCUMENTS 3,247,033 4/1966 Gordon ..... 149/46 X

*Primary Examiner*—Stephen J. Lechert, Jr.
*Attorney, Agent, or Firm*—Cushman, Darby & Cushman

[57] ABSTRACT

A process for making an explosive composition which process comprises heating a mixture comprising at least one oxygen releasing salt and at least one compound selected from a class of melt soluble fuel materials so as to form a melt, and adding to the melt an amount of oxygen releasing salt material whereby there is formed an explosive composition which is pourable, pumpable or flowable over a wide range of temperature. Explosive compositions are described also.

24 Claims, No Drawings

EXPLOSIVE COMPOSITION FLOWABLE OVER WIDE TEMPERATURE RANGE

This invention relates to explosive compositions, and relates more particularly to the preparation of explosive compositions of the non aqueous type comprising oxidizer salt material and melt soluble fuel material.

Non aqueous explosives wherein a major constituent is an oxidizer salt, such as ammonium nitrate, have been known for many years. Thus as early as 1934 in U.S. Pat. No. 2,063,572 there are descriptions of processes for making high density explosives by incorporating ammonium nitrate and a freezing point depressant to produce a composition which had a relatively broad melting point range and heating it to a temperature sufficient to liquify a portion only of the ammonium nitrate with the freezing point depressant. The material so produced was compacted by extruding whilst it was hot and then pressed or tamped into containers wherein it cooled to a solid, high density explosive. In this document it was taught that ammonium nitrate by itself was not sufficiently sensitive for use as an explosive and it was preferred that there be included in the composition up to 25% of a sensitizing agent such as trinitrotoluene or pentaerythritol tetranitrate. In U.S. Pat. No. 2,817,581 there is described a cast explosive composition comprising a solid mixture of 14 to 20 parts by weight of urea, 1 to 6 parts by weight of a high explosive sensitizing component such as cyclotrimethylene trinitramine and the remainder to 100 parts of ammonium nitrate. In U.S. Pat. No. 2,814,555 there is described another cast solid explosive composition comprising 16–21 parts by weight of urea crystals, 1–3 parts of an absorbent such as kaolin in admixture with an amount of ammonium nitrate sufficient to give 100 parts of an explosive composition. In British Patent Specification No. 839,078 there is provided a cast ammonium nitrate explosive discontinuous foamed composition which is characterized in that it has gaseous pockets dispersed throughout its structure which comprises a gasified mixture of ammonium nitrate and a fuel which constitutes from 2 to 20% w/w of the composition. In U.S. Pat. No. 3,135,637 there is described a solid blasting explosive comprising a reaction mixture of ammonium nitrate and a urea-aliphatic hydrocarbon clathrate. Still further in U.S. Pat. No. 3,247,033 there is described solid explosive compositions comprising ammonium nitrate and primary fuel material optionally in combination with secondary fuel material and modifying material. It is taught therein that the components of such compositions should be heated to a temperature between 150° C. and 165° C. to form a molten mass which is then chilled rapidly to form a solid product which is subsequently flaked, granulated and densified and which is said to be advantageous in that it contains a desirable crystal form, is less prone to segregation and non-homogeneity of the components and leads to enhanced contact between the components of the composition.

The compositions referred to above are typical of known non-aqueous oxidizer salt explosive compositions and they have a common attribute in that they are solid compositions and it is taught in the documents describing them that they should be used in the solid state. Thus they are designed to be used in a manner similar to that for the well known mixtures of ammonium nitrate and fuel oil (ANFO). Whilst such compositions are satisfactory in many respects as explosives, they have suffered from the disadvantage that it has often been found to be difficult in practice to load them into boreholes at commercially acceptable loading rates. Thus to achieve a desired packing density, and hence a desired available bulk energy, it is common to use vibrating or tamping means to locate dry explosive compositions in boreholes. Such means are sometimes not effective when granular prior art compositions are loaded at high rates into large diameter boreholes, leading to reduced and nonhomogeneous packing densities. So as to overcome these deficiencies of solid explosives it has been proposed to use water bearing explosive compositions which in general terms comprise a mixture of oxidizing salt material, fuel material and water in proportions such that the compositions are pourable or pumpable. These compositions, often referred to as slurry explosives, have been useful, but they suffer from the disadvantage that the water component thereof acts as a diluent which contributes little to the energy which becomes available when the composition is detonated. So as to provide flowable compositions devoid of a water component it has been proposed that explosive compositions having low solidification points be made. Thus in U.S. Pat. No. 3,926,696 provision is made for explosive compositions having as essential components an oxygen supplying salt such as a ammonium nitrate, a metallic fuel such as aluminium or magnesium, and an eutectic mixture comprising an oxygen supplying salt and a combustible compound which lowers the solidification point of the salt and wherein the compositions are characterized in that they have solidification points below +10° C. and preferably below −10° C. In U.S. Pat. No. 3,996,078 which was derived from U.S. Pat. No. 3,926,696 there is described an eutectic composition consisting essentially of an oxygen supplying salt, a combustible compound and at least 30% w/w of a nitrate or perchlorate of an alkanolamine, the composition having a solidification point below −10° C.

In the realm of explosives manufacture it is considered to be desirable to use process conditions or components of compositions which lead to a minimum of hazard. Thus for example temperatures used in the preparation of explosive compositions are preferably kept relatively low so as to avoid undesired detonation or burning of the compositions, and the use of such lower temperatures has the attendant advantage that the consumption of fuel is lessened thereby. The usage of fuel is also lessened if, when it is necessary to convert a solid composition to a molten form, the composition melts at a relatively low temperature and has a sharp melting point so that the melting process is not unduly prolonged. Whilst it is desirable that explosive compositions should be reasonably sensitive to detonation, the degree of such sensitivity should be balanced against the hazard involved with the use of sensitizing agent. Thus whilst the sensitivity to detonation of a composition can sometimes be improved by the use of high explosives such as trinitrotoluene, nitroglycerine, pentaerythritol tetranitrate, picric acid, nitro starch, cyclotrimethylenetrinitramine and the like, care has to be taken in using such high explosives and, where for a particular purpose their use as an optional component of a composition is necessary, the proportion thereof should be as small as possible. Desirably other sensitizers should be used. Similarly the use of other hazardous chemicals, such as organic substances like the alkanolamine nitrates, alkanolamine perchlorates or unstabilized alkylene glycol nitrates, or inorganic materials like finely divided aluminium, magnesium or ferrosilicon as essential ingredients of the compositions should be avoided and where such materials are used as optional components of the compositions they should constitute as small a proportion of the composition as is commensurate with the desired use of the composition. It is usually desirable that an explosive composition has a high power to volume ratio and hence the presence of inert materials, such as water or fillers such as kaolin is, under such conditions not desirable, neither is a composition which has a low density such as a foamed explosive composition, nor is a composition which is discontinuous at its location of use such as in a borehole.

There has now been discovered a process for the manufacture of new explosive compositions which provides compositions with an explosive power similar to that of known non-aqueous explosive compositions and which may be pumped, poured or flowed to a desired position whereat it is optionally allowed to solidify and thereafter be detonated without further treatment. Furthermore these new compositions are devoid, in terms of essential components, of high explosive materials and by suitable choice of essential components the use of undesirable materials or physical characteristics as outlined above may be minimized or even avoided. In a broad form the invention relates to processes for making explosive compositions, and to the explosive compositions so made, which processes comprise forming a melt from a mixture comprising at least one oxygen releasing salt and at least one compound selected from a class of melt soluble fuel materials and adding to the melt an amount of oxygen releasing salt material whereby there is formed an explosive composition which is pourable, pumpable or flowable over a wide range of temperatures.

Accordingly in an embodiment of the invention there is provided a process for the manufacture of an explosive composition which is pourable, pumpable or flowable at a temperature in the range from −10° to +90° C. which process comprises first treating a mixture comprising at least one oxygen releasing salt and a compound or a mixture of compounds selected from a class of melt soluble fuel materials, as hereinafter defined, optionally by the application of heat, at a temperature in a range from −10° C. to +90° C. and preferably at a temperature in a range from 0° C. to 60° C. so as to form a melt; optionally dispersing in said melt a thickening agent which optionally may be crosslinked; secondly incorporating into said melt an amount of at least one oxygen releasing salt material such that the said incorporated salt material constitutes from 40 to 80% w/w of the said composition and the said melt constitutes from 20 to 60% w/w of the said composition. Suitably and preferably the oxygen releasing salt component comprises ammonium nitrate. Any commercial grade of ammonium nitrate is suitable for use in the process of the invention. It is preferred that the ammonium nitrate be dry, although small amounts of water, say up to about 3% w/w of the components used in making the composition, whilst not desired, can be tolerated in the process. Such water may be inherent in the components, for example the components may be deliquescent or contain water of hydration, or it may have been absorbed or adsorbed by the components in the period between their manufacture and the time when the explosive composition has been manufactured. Fertilizer grade prills which are coated with a material to prevent caking may be used, but it is preferable to use some uncoated or crushed ammonium nitrate with it to aid the preparation of the melt. Other oxygen releasing salts which may be used if desired in the process include for example alkaline earth metal or alkali metal nitrates, chlorates and perchlorates, ammonium chlorate or ammonium perchlorate. By melt soluble fuel material is meant a fuel material of which at least a part, and preferably all, is capable of forming a melt with at least a part of the oxygen releasing salt component and wherein the temperature at which such a melt is formed is no greater than is the melting point of either the fuel material or the oxygen releasing salt component. It is desirable that the melt soluble fuel material be capable of forming a miscible melt with ammonium nitrate since this compound is a preferred oxygen releasing salt. Thus in a more restricted form such melt soluble fuel materials, hereinafter referred to as primary fuels, may be defined as organic compounds which form a homogeneous melt with ammonium nitrate at temperatures up to 90° C. and which are capable of being oxidized by ammonium nitrate to form substantially all gaseous products. The primary fuel may be a single compound or a mixture of two or more compounds. Suitable primary fuels include carboxylates, thiocyanates, amines, imides or amides. Typical useful primary fuels include ammonium acetate, ammonium formate, ammonium thiocyanate, hexamethylene tetramine, dicyandiamide, thiourea, acetamide, urea and mixtures thereof. Urea is a preferred primary fuel.

The temperature at which the mixture of oxygen releasing salt material and the primary fuel material is treated so as to form a melt will vary dependent to some extent on the nature of the components and their proportions used to make the melt. Thus for example the temperature at which the melt will form can conveniently lie in a range from about −10° C. to +90° C. Whilst it is satisfactory to treat the mixture at a temperature only slightly above the melt-formation temperature it is often advantageous that the treatment be performed at temperatures some what above the melt-formation temperature. Thus it may be desirable that the melt be heated to a treatment temperature which is from about 50° to 80° C. above the melt formation temperature prior to the incorporation of the oxygen-releasing salt material, so that when such an incorporation is made the resultant temperature of the composition so prepared is still sufficiently high to ensure that the viscosity of the composition is such that the composition may be poured, pumped or flowed. It is desirable that such a treatment temperature be not in excess of 110° C., but treatment temperatures up to this value may be used if for example it was desirable to remove an undesired impurity or to remove volatile inert material such as water from the melt. For most practical purposes it is convenient that the treatment-temperature lie in a range which is from about 5° to 45° C. above the melt-formation temperature.

It is desirable in the interests of safety and economy to prepare melts having a low melt-formation temperature and in many instances melts can be prepared at temperatures which are not in excess of 90° C. Mixtures of primary fuels are useful and by judicious choice of the components of such a mixture it is possible to form a melt by the process of the invention at melt-formation temperatures considerably below 60° C. Thus for example a mixture of 5 parts by weight of urea, 3 parts by weight of ammonium acetate, and 2 parts by weight of acetamide when premixed and added to 10 parts of ammonium nitrate needs to be heated only to about 35° C. before a melt is formed. In certain instances a melt may be formed merely by mixing the salt material and the fuel component. Thus a mixture of ammonium nitrate/urea/ammonium acetate/ammonium formate in a weight ratio of 8:6:3:3 is fluid at a temperature of −10° C. If the above weight ratio is altered to 9:6:2:3 it is found that the mixture is a liquid at a temperature of 20° C., but that some heat has to be applied to the mixture to maintain it at a temperature in excess of about 14° C., below which temperature crystalline material separates from the mixture. Mixtures of ammonium nitrate and urea in a weight ratio of 53:47 having a melting point of about 45° C., and ammonium nitrate/sodium nitrate/urea in a weight ratio of 468:97:435 having a melting point of 35° C. are illustrative of melts comprising a single melt soluble fuel material. If desired there may be used as components of the compositions made by the process of the invention other optional fuel materials referred to hereinafter as secondary fuel materials. Such secondary fuel materials may be chosen from a range of materials and include for instance liquid or solid carbonaceous materials. Suitable such materials include oils such as hydrocarbon oils, fuel oils such as diesel fuel oils, fatty oils or vegetable oils; comminuted coke or charcoal, carbon black; resin acids such as abietic acid or derivatives thereof; sugars such as sucrose or dextrose; or other vegetable products such as starch, nut meal or wood pulp. Diesel fuel oil is a preferred secondary fuel material of the carbonaceous type. Finely divided metals, such as aluminium powder, may also be used as secondary fuels to form explosive compositions prepared by the process of the invention.

The thickening agents when used in the process of the invention, are suitably polymeric materials, especially gum materials typified by the galactomannan gums such as locust bean gum or guar gum or derivatives thereof such as hydroxypropyl guar gum. Other useful, but less preferred, gums are the so called biopolymeric gums such as the heteropolysaccharides prepared by the microbial transformation of carbohydrate material, for example the treatment of glucose with a plant pathogen of the genus Xanthomonas typified by *Xanthomonas campestris*. When it is desired to crosslink the thickening agent it is convenient to use conventional crosslinking agents such as zinc chromate or a dichromate either as a separate entity or as a component of a conventional redox system for example a mixture of potassium dichromate and potassium antimony tartrate. Surprisingly it has been found in many instances that the thickening agents do not require the presence of water in the compositions to be efficacious. However should it be considered desirable that the solvation of gummy thickening agents or their crosslinking would be enhanced by the presence and use of small amounts of water or a water-bearing medium, it lies within the invention that there be used in the process a sufficiency of water to enable such solvation or crosslinking to be effected.

The temperature at which the product made by the process of the invention is maintained prior to use will vary dependent to some extent on the nature of the composition and the use to which it is to be put. The temperature should not be so high as to induce decomposition of the product during storage, neither should it be so low as to cause it to solidify prior to being transferred to a desired location. Typically the upper limit of the temperature should not exceed 110° C. and more usually lies in the range from 90° to 30° C. The lower limit is dictated mainly by the solidifying temperature of the product and the degree of cooling to which the product is subjected whilst in storage and during transference from the storage unit to the desired position. With the assistance of modern insulating materials it has been found in practice that the product may be stored at temperatures which are in a range from 5° to 20° C. above their solidifying point and then pumped to a desired location. In the instance where a low density explosive is required or there is a use for an explosive having a low power to volume ratio the process of the invention may be modified to allow for the generation of a gas in the molten explosive composition. Typical gas-producing materials include salts such as sodium nitrite.

The process of the invention is advantageous over known processes for making similar products in that it provides a means whereby the product so made can be utilized more effectively than similar solid products. High, and predictably variable bulk energies can be obtained from the fluid compositions made by the process of the invention without the need to resort to known mechanical, vibratory or other similar techniques used to induce densification of solid products in boreholes. Thus the fluid products resultant from the process of the invention can be located more effectively in boreholes than can the known solid similar products and this has the attendant advantage that they are more useful during blasting processes in respect of generated explosive power per unit length of borehole. Still further from a practical aspect it is found that the fluid products made by the process of the invention occupy less space during storage than do similar solid dry blasting agents. Yet again the said fluid products are more easily handled and transferred at a wider range of densities than are the conventional solid dry blasting agents.

Yet again our process requires a lesser amount of heat energy to form the explosive compositions of the invention than do processes of the prior art. Furthermore, since the temperatures used in the process of the invention are less than those of prior art processes there is a reduced degree of hazard in making the explosive compositions described hereinbefore. Since the compositions made by the process of the invention may be used in liquid or solid form there is no need to flake, granulate or densify the product prior to use, as is necessary with the products described in U.S. Pat. No. 3,247,033, and hence their preparation is the less hazardous than the preparation of the products of the above specification.

The compositions made by the process of the invention differ advantageously in physical form from the known solid non-aqueous oxidizer salt explosive compositions of the prior art in that the compositions of the invention are in a fluid form. The temperature at which such compositions are fluid will depend to some extent on the nature and proportion of components in the compositions. However in general terms compositions may be prepared so that they are fluid at temperatures in a range from below 0° C., say about −10° C., up to about 90° C. Compositions which are fluid in a temperature range from 0° C. up to 60° C. are particularly useful.

Accordingly in a further aspect of the invention there is provided an explosive composition of a non-aqueous oxidizer salt type which is characterized in that it assumes a molten form at temperatures in a range from −10° C. to +90° C., preferably in a range from 0° to 60° C. and more preferably in a range from 15° to 45° C. and comprises as a first component a product resultant of treatment of a mixture comprising at least one oxygen-releasing salt and at least one compound selected from a class of melt-soluble fuel materials as hereinbefore defined so as to form a melt; and as a second component a further amount of at least one oxygen releasing salt material such that the said first component constitutes from 20 to 60% w/w, preferably from 25 to 45% w/w, of the said composition and wherein the said second component constitutes from 40 to 80% w/w of the said composition. Conveniently the said first component comprises from 30 to 70% w/w, preferably from 40 to 60% w/w of oxygen releasing salt material. Preferably the oxygen releasing salt material in both the first and second components of the compositions is ammonium nitrate but other oxygen releasing salt materials such as those referred to hereinbefore may be used to replace at least a part of compositions comprising ammonium nitrate. Thus for example such a replacement may be effected by using an amount of sodium nitrate or calcium nitrate such that it constitutes up to about 15% w/w of a composition of the invention. Where desired it lies within the invention for the explosive composition to contain other components used conventionally in oxidizer salt type explosives. Thus it is often convenient that the compositions contain from 0 to 5% w/w of secondary fuel material as hereinbefore described. It is sometimes advantageous that the compositions may comprise thickening material which optionally is cross-linked. Unlike prior art non-aqueous explosive compositions such as are described for example in U.S. Pat. No. 2,063,572 and which have a broad melting point range in the region of 90° C., the melt components of the present compositions have narrow melting point ranges and any meltable material therein may be converted to a molten form. In contradistinction to the granulated crystalline explosives of U.S. Pat. No. 3,247,033 in which it is essential that the continuous phase comprises air, the compositions of the invention have as the continuous phase the explosive itself in fluidized, typically molten, form or as a solid derived from the fluidized form. Thus the compositions of the invention behave in a manner similar to that to be expected from a conventional high explosive of low sensitivity. Advantageously the presence of a relatively incompressable continuous explosive phase in the compositions of the invention maintains the high velocity of the explosive shock wave leading to higher velocities of detonation and the achievement of a maximum of hydrodynamic velocity of detonation. The compositions of the invention are eminently suitable for use in conjunction with conventional pumping or mixing trucks designed for use with known water based explosives of the so-called slurry type. Thus for example a thickened melt component of the compositions of the invention may be placed in the solution tank of such a conventional mixing truck and the residual components of the compositions may be added to and mixed with the melt in a conventional manner and thereafter the composition of the invention so prepared may be transferred to a borehole wherein it may be detonated.

Accordingly in an embodiment of the invention there is provided a process for loading a borehole with an explosive composition of the invention as herein described.

This invention is now illustrated by, but is not limited to, the following examples in which all parts and percentages are expressed on a weight basis unless otherwise specified.

EXAMPLE 1

Into an insulated vessel fitted with stirring and heating means and connected to a pumping and delivery means there was added 1750 parts of urea and 1750 parts of crushed ammonium nitrate. The contents of the vessel were stirred and heated and it was observed that at a temperature of about 45° C. the contents of the vessel were converted to a molten form over a narrow range of temperature. Heating of the melt so formed was continued until the temperature thereof was 60° C. and then 25 parts of a thickening agent available commercially from General Mills Incorporated of U.S.A. under the designation "Gengel" E2 were then added to and dispersed in the stirred melt to provide a thickened melt. Stirring of the thickened melt was continued for 5 minutes and then there was added thereto 5 parts of sodium nitrite, 70 parts of diesel fuel oil and 10 parts of zinc chromate. These components were stirred into the melt for one minute and then 6430 parts of powdered ammonium nitrate were added slowly with mixing to the contents of the vessel which after this addition had a temperature of 50° C. and was in a form of a fluid slurry. A portion of the fluid slurry was pumped by the pumping means through the delivery means to a simulated cylindrical borehole in the form of a cylindrical steel tube which had a diameter of 5 centimeters and was 60 centimeters long. The fluid slurry in the borehole was allowed to cool therein to a solid form which had a density of 1.25 grams per cubic centimeter. The solid explosive in the borehole was detonated by means of 100 grams of pentolite and had a velocity of detonation of 4.8 kilometers per second.

EXAMPLE 2

Into the vessel of Example 1 there was placed 25 parts of "Gengel" E, 1750 parts of urea and 1750 parts of crushed ammonium nitrate and these components were stirred to provide a uniform mixture. The contents of the vessel were then heated with stirring to a temperature of 55° C. and to the thickened melt so obtained there was added 70 parts of diesel fuel oil, followed by 10 parts of zinc chromate, then 5 parts of sodium nitrite and 6430 parts of powdered ammonium nitrate. The components were stirred at 55° C. to form a fluid explosive slurry which was then pumped smoothly and evenly by an air-driven piston pump through a flexible hose which had an internal diameter of 2.5 centimeters into simulated cylindrical boreholes having a diameter of 5 centimeters and a length of 60 centimeters. The slurry was allowed to cool to a solid form and was then detonated in each borehole by means of 100 grams of pentolite. The velocity of detonation was 4.9 kilometers per second.

EXAMPLE 3

Into the vessel of Example 1 there was placed 4 parts of "Gengel" E2, 232 parts of crushed ammonium nitrate, 28 parts of acetamide, 42 parts of ammonium acetate and 162 parts of urea, and these materials were stirred to provide a uniform mixture. The contents of the vessel were then heated with stirring to a temperature of 55° C. and then 1 part of sodium nitrite, 10 parts of diesel fuel oil and 1 part of zinc chromate were added to the contents of the vessel. The temperature of the mixture so obtained was maintained at a temperature between 50 and 55° C. whilst 616 parts of powdered ammonium nitrate was stirred into the mixture. The fluid explosive slurry so obtained was pumped into simulated cylindrical boreholes having a diameter of 5 centimeters and a length of 60 centimeters and allowed to cool and solidify to an explosive which had a packing density of 1.1 gram per cubic centimeter. When detonated by means of a 200 gram pentolite booster it had a detonation velocity of 3.5 kilometers per second.

EXAMPLE 4

The general procedure of Example 3 was repeated except that in the present example no diesel fuel oil was used. The fluid explosive cooled to a solid having a packing density of 1.2 gram per cubic centimeter, and when detonated by means of 100 grams of pentolite, it had a velocity of detonation of 4 kilometers per second.

EXAMPLE 5

The general procedure of Example 2 was repeated except that the melt of the example was replaced by a thickened melt obtained by treating a mixture of 1638 parts of ammonium nitrate, 340 parts of sodium nitrate, 1522 parts of urea and 45 parts of hydroxypropyl guar gum available commercially under the designation "Jaguar" HP8. ("Jaguar" is a Registered Trade Mark). The solidified explosive had a packing density of 1.17 gram per cubic centimeter and when detonated by means of 50 grams of pentolite it had a velocity of detonation of 4.6 kilometers per second.

EXAMPLE 6

The general procedure of Example 5 was repeated except that the amount of the thickened melt component was reduced from 3545 parts to 3000 parts, the amount of diesel fuel oil was increased to 180 parts and the amount of powdered ammonium nitrate was changed to 5850 parts. The velocity of detonation was 4.3 kilometers per second.

EXAMPLE 7

The general procedure of Example 6 was repeated except that the sodium nitrite of that example was omitted. There was thus obtained an explosive composition which had a density of 1.45 gram per cubic centimeter and a detonation velocity of 1.9 kilometer per second when initiated by means of 200 grams of pentolite.

EXAMPLE 8

An explosive composition was made by the general procedure of Example 6 except that the diesel fuel oil component of that example was omitted and replaced by 40 parts of dextrose. Prior to loading the composition so prepared into the boreholes there was added as a final component of the mixture 20 parts of aluminium powder prepared from commercially available paint-fine grade aluminium which had been treated with an amount of polytetrafluoroethylene sufficient to agglomerate a proportion of the aluminium. The resultant explosive composition had a density of 1.2 gram per cubic centimeter and a detonation velocity of 4.5 kilometers per second when detonated by means of 100 grams of pentolite.

EXAMPLE 9

The general procedure of Example 8 was repeated except that the powdered ammonium nitrate of that example was replaced by an equal amount of porous ammonium nitrate prills which contained occluded air. The product so obtained had a density of 1.05 gram per cubic centimeter. It was loaded into a cylindrical cardboard tube of 7.5 centimeters diameter and 60 centimeters long, and had a velocity of detonation of 3.6 kilometers per second when detonated by means of 200 grams of pentolite.

EXAMPLE 10

An explosive composition was made by the general procedure of Example 6 except that no sodium nitrate was incorporated into the composition. The composition so made was transferred to a high speed mixer of the planetary type and was subjected to rapid agitation until the product had a density of 1.16 gram per cubic centimeter. It was then transferred to a simulated bore hole which was a steel cylindrical pipe having a diameter of 10 centimeters and a length of 60 centimeters, and when detonated therein the composition had a velocity of detonation of 4.2 kilometers per second.

EXAMPLE 11

A composition was prepared by the general procedure of Example 6. When loaded into waxed cardboard cylinders having a diameter of 12.5 centimeters and a length of 30 centimeters and detonated by means of 200 grams of pentolite, the composition, which had a density of 0.86 gram per cubic centimeter, had a velocity of detonation of 3.3 kilometers per second.

EXAMPLE 12

An explosive composition was prepared by heating 120 parts of acetamide, 180 parts of crushed ammonium nitrate, and 5 parts of "Jaguar" HP8 at 70° C. for a time sufficient to form a melt. To this melt there was added with stirring, 1 part of sodium nitrite, 1 part of zinc chromate and 700 parts of powdered ammonium nitrate. The composition was detonated in a steel cylinder of diameter 5 cm and a length of 60 cm by means of 100 grams of pentolite.

EXAMPLE 13

40 parts of crushed ammonium nitrate was added to and mixed with 30 parts of urea, 15 parts of ammonium formate and 15 parts of ammonium acetate to form a liquid which was still fluid at a temperature −10° C. To this liquid at a temperature of 20° C. there was added 200 parts of powdered ammonium nitrate and thus there was produced a liquid explosive composition which could be stored as such at ambient temperatures. The composition was placed in a cylindrical steel tube having a length of 60 centimeters and a diameter of 20 centimeters and when detonated therein it had a velocity of detonation of 3.4 kilometers per second.

EXAMPLE 14

An explosive composition was prepared according to the general procedure of Example 12 except that the acetamide was reduced to 100 parts, the crushed ammonium nitrate decreased to 150 parts and the "Jaguar" HP-8 reduced to 3 parts. In addition 10 parts of diesel fuel oil were incorporated in the mix and the powdered ammonium nitrate was increased to 740 parts. The composition which had a density of 1.05 grams per cubic centimeter, was detonated in a steel cylinder by means of a 100 g pentolite booster and had a velocity of detonation of 3.9 kilometers per second.

EXAMPLE 15

The general procedure of Example 5 was repeated except that the thickening agent was omitted. At a density of 1.33 grams per cubic centimeter the composition was detonated by means of a 454 g pentolite booster when loaded into a cardboard tube 20 centimeters in diameter. The explosive composition had a velocity of detonation of 2.7 kilometers per second.

EXAMPLE 16

A thickened melt was prepared by heating a stirred mixture of 193 parts of crushed ammonium nitrate, 41 parts of sodium nitrate, 162 parts of urea and 2 parts of "Gengel" E2 to a temperature of 80° C. To this melt there was added with mixing 582 parts of crushed ammonium nitrate, 1 part of zinc chromate, 18 parts of diesel fuel oil and 1 part of sodium nitrite. The composition so prepared was placed in a cylindrical steel tube which had a diameter of 5 centimeters and which contained water. The composition was kept in contact with the water for eight days at ambient temperature. At the end of this period the bulk of the water was removed and the composition was then detonated using a primer containing 100 grams of pentolite. The velocity of detonation of the water-resistant composition so prepared was 2.5 kilometers per second.

EXAMPLE 17

A composition prepared by the general method of Example 16 was placed in a steel cylinder having a diameter of 5 centimeters and the cylinder and its contents were then placed in a sealed bag fabricated from polyethylene film. The bag and its contents were placed in a water bath and subjected to a multiplicity of cyclic temperature changes ranging from 5 to 50° C. for a period of five weeks. At the end of this time the cylinder and its contents were removed from the bag and the contents were detonated using a booster containing 100 grams of pentolite. The velocity of detonation was 3.2 kilometers per second. This example illustrates the heat stability of a composition of the invention during storage.

EXAMPLE 18

A detonable composition was prepared by heating to a temperature of 86° C. a mixture of 164 parts of urea, 341 parts of crushed ammonium nitrate and 41 parts of calcium nitrate thereby forming a melt to which was added with stirring 13 parts of diesel fuel oil and 441 parts of ammonium nitrate. At a temperature of 50° C. the product so made was a slurry-like material.

EXAMPLE 19

A melt was prepared by heating a stirred mixture of 194 parts of crushed ammonium nitrate, 41 parts of crushed sodium nitrate, and 162 parts of urea to a temperature of 76° C., and then adding 2 parts of "Gengel" E2 followed by 585 parts of crushed ammonium nitrate, 1 part of sodium nitrite and a dispersion of 1 part of zinc chromate in 14 parts of diesel fuel oil. The components were stirred at a temperature of 35° C. to provide a uniform pumpable detonable mixture. The water resistant mixture so prepared was reheated to a temperature of 38° C., placed in an insulated container and transported to a site where blasting operations were conducted. The site referred to above was in columnar basalt and in the basalt there was drilled a row of four vertical cylindrical boreholes which were 3 meters apart and each of which had a depth of 6.3 meters and a diameter of 7.5 centimeters. The site was wet and compressed air was fed into the boreholes to remove the bulk of the water therein, but it was observed that the walls of the boreholes were still slightly wet after the treatment with air. A first primer containing 250 grams of pentolite was lowered on wires to the bottom of the borehole and 23 kilograms of the detonable mixture were pumped into the borehole to provide a column of explosive which was 2.7 meters long. A second primer containing 250 grams of pentolite was lowered on wires on to the column of explosive and then a further 2 kilograms of the detonable mixture was pumped into the borehole. Thereafter the borehole was stemmed and the primers were each connected to a delay detonator having a delay period of 80 milliseconds. In a similar manner the residual three boreholes were primed and charged with the explosive material. For these holes there were used pairs of detonators having delay periods of 105, 130 and 155 milliseconds respectively. The eight detonators were connected in a series circuit and fired by conventional means. The resultant detonation of the explosive composition of the invention provided good fragmentation of the basalt.

EXAMPLE 20

650 parts of ammonium nitrate powder, 650 parts of urea, 750 parts of hexamethylene tetramine, 100 parts of abietic acid and 40 parts of hydroxy propylated guar gum were placed in a reaction vessel and heated with stirring to a temperature of 80° C. to provide a thickened melt, and into this stirred melt then was added 7900 parts of crushed ammonium nitrate, 9 parts of sodium nitrite, and 9 parts of zinc chromate. The resultant fluid composition was poured into a cylindrical cardboard tube having a diameter of 5 centimeters wherein it solidified. This solidified explosive which had a bulk density of 0.86 gram per cubic centimeter was detonated at a temperature of 18° C. by means of two No. 8 aluminium detonators.

What is claimed is:

1. An explosive composition of a non-aqueous oxidizer salt type which is characterized in that it assumes a molten form at temperatures in a range from −10° C. to +90° C. and comprises as a first component a product resultant of treatment of a mixture comprising at least one oxygen-releasing salt material and at least one compound selected from a class of melt-soluble fuel materials, of which at least a part of said fuel material is capable of forming a melt with at least a part of said oxygen-releasing salt material and wherein the temperature at which such a melt is formed is no greater than is the melting point of either the said fuel material or the said oxygen-releasing salt material, so as to form a melt; and as a second component a further amount of at least one oxygen-releasing salt material such that the said first component constitutes from 20 to 60% w/w of the said composition and the said second component constitutes from 40 to 80% w/w of the said composition.

2. A composition according to claim 1 wherein the said oxygen-releasing salt material is selected from the group consisting of the nitrates, chlorates and perchlorates of alkali metals, alkaline earth metals and ammonium.

3. A composition according to claim 1 wherein the said oxygen-releasing salt material is selected from the group consisting of calcium nitrate and sodium nitrate.

4. A composition according to claim 1 wherein the said oxygen-releasing salt material is ammonium nitrate.

5. A composition according to claim 1 wherein the said fuel material is selected from the group consisting of carboxylates, thiocyanates, amines, imides and amides.

6. A composition according to claim 5 wherein the said fuel material is selected from the group consisting of ammonium acetate, ammonium formate, ammonium thiocyanate, hexamethylene tetramine, dicyandiamide, thiourea and acetamide.

7. A composition according to claim 5 wherein the said fuel material comprises urea.

8. A composition according to claim 1 wherein the said first component constitutes from 25 to 45% w/w of the said composition.

9. A composition according to claim 1 wherein the said first component comprises from 30 to 70% w/w of the said oxygen-releasing salt material.

10. A composition according to claim 1 wherein the said first component comprises from 40 to 60% w/w of the said oxygen-releasing salt material.

11. A composition according to claim 1 comprising up to 5% w/w of secondary fuel material selected from the group consisting of liquid carbonaceous materials, solid carbonaceous materials and finely divided metals.

12. A composition according to claim 11 wherein the said secondary fuel material is an oil.

13. A composition according to claim 12 wherein the said secondary fuel material is a diesel fuel oil.

14. A composition according to claim 11 wherein the said secondary fuel material is a sugar.

15. A composition according to claim 11 wherein the said secondary fuel material is aluminium powder.

16. A composition according to claim 1 comprising in addition at least one thickening agent which optionally may be crosslinked.

17. A composition according to claim 1 wherein the said composition assumes a molten form at temperatures in a range from 0° C. to 60° C.

18. A composition according to claim 1 wherein the said composition assumes a molten form at temperatures in a range from 15° C. to 45° C.

19. A process for the manufacture of an explosive composition which is pourable, pumpable or flowable at a temperature in the range from −10° C. to +90° C. which process comprises first treating a mixture comprising at least one oxygen-releasing salt and at least one compound selected from a class of melt soluble fuel materials, of which at least a part of said fuel material is capable of forming a melt with at least part of said oxygen-releasing salt material and wherein the temperature at which such a melt is formed is no greater than is the melting point of either of the said fuel material or the said oxygen-releasing salt material, optionally by the application of heat, at a temperature in a range from −10° C. to +90° C. so as to form a melt; optionally dispersing in said melt a thickening agent, which optionally may be crosslinked; secondly incorporating into said melt an amount of at least one oxygen-releasing salt material such that the said incorporated salt material constitutes from 40 to 80% w/w of the said composition and the said melt constitutes from 20 to 60% w/w of the said composition.

20. A process according to claim 19 wherein said mixture is treated at a temperature in a range from 0° C. to 60° C.

21. A process for loading a borehole with an explosive composition which process comprises transferring an amount of an explosive composition according to claim 1 to said borehole, said composition being characterized in that it is in a pourable, flowable or pumpable form.

22. A process according to claim 21 comprising the additional step of converting the said composition in the said borehole to a solid form.

23. A composition according to claim 4 which is a liquid composition at ambient temperatures.

24. A composition according to claim 7 which is a liquid composition at ambient temperatures.

* * * * *